US011396192B2

(12) United States Patent
Dirsch et al.

(10) Patent No.: US 11,396,192 B2
(45) Date of Patent: Jul. 26, 2022

(54) DIGITAL WEB PRINTING PRESS, CONTROL APPARATUS AND METHOD FOR OPERATING THE DIGITAL WEB PRINTING PRESS

(71) Applicant: Siemens Aktiengesellschaft, Munich (DE)

(72) Inventors: Bernhard Dirsch, Erlangen (DE); Philipp Rost, Fürth (DE); Elmar Schäfers, Fürth (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 307 days.

(21) Appl. No.: 16/831,037

(22) Filed: Mar. 26, 2020

(65) Prior Publication Data

US 2020/0307264 A1 Oct. 1, 2020

(30) Foreign Application Priority Data

Mar. 28, 2019 (EP) ..... 19165838

(51) Int. Cl.

*B41J 11/42* (2006.01)
*B41J 11/00* (2006.01)
*B41J 11/46* (2006.01)

(52) U.S. Cl.

CPC ..... *B41J 11/42* (2013.01); *B41J 11/008* (2013.01); *B41J 11/46* (2013.01)

(58) Field of Classification Search

CPC ..... B41J 11/42; B41J 11/008; B41J 11/46
See application file for complete search history.

(56) References Cited

U.S. PATENT DOCUMENTS

2006/0050099 A1 3/2006 Murakami et al.
2010/0290064 A1 11/2010 Hara et al.
2011/0316909 A1 12/2011 Yamanobe
2014/0168298 A1 6/2014 de Jong et al.
(Continued)

FOREIGN PATENT DOCUMENTS

CN 1623792 A * 6/2005 ..... B41J 2/04505
CN 1746028 3/2006
CN 102294888 12/2011
(Continued)

*Primary Examiner* — Justin Seo
(74) *Attorney, Agent, or Firm* — Cozen O'Connor

(57) ABSTRACT

A digital web printing press, control apparatus and method for operating the digital web printing press includes selecting a frequency for actuating a digital printing head at the frequency to output printing ink onto a print web, wherein a specified conveying speed for conveying the print web is ascertained based on the selected frequency and printing data, a motor driving a first roller and/or a motor driving a second roller is controlled based on the specified conveying speed such that the print web between the first roller and the second roller is conveyed at the specified conveying speed and the digital printing head at the selected frequency and activated based on the printing data such that the digital printing head is advantageously actuated at a selected, fixed frequency, and such that complex dynamic actuation of the digital printing head and an associated measurement and control system are eliminated.

22 Claims, 3 Drawing Sheets

(56) References Cited

U.S. PATENT DOCUMENTS

| | | | |
|---|---|---|---|
| 2015/0009255 | A1 | 1/2015 | Matsunaga |
| 2018/0022119 | A1 | 1/2018 | Kamigiku et al. |

FOREIGN PATENT DOCUMENTS

| | | | | | |
|---|---|---|---|---|---|
| CN | 103862863 | | | 6/2014 | |
| CN | 104275941 | | | 1/2015 | |
| CN | 109572221 | A | * | 4/2019 | ..... B41J 2/14 |
| DE | 102015104575 | | | 9/2016 | |
| EP | 2251201 | | | 11/2010 | |
| EP | 3275676 | | | 1/2018 | |
| JP | 2019107829 | A | * | 7/2019 | ..... B41J 13/0027 |

* cited by examiner

DIGITAL WEB PRINTING PRESS, CONTROL APPARATUS AND METHOD FOR OPERATING THE DIGITAL WEB PRINTING PRESS

BACKGROUND OF THE INVENTION

1. Field of the Invention

The present invention relates to a digital web printing press, a control apparatus for operating the digital web printing press and to a method for operating the web printing press.

2. Description of the Related Art

In digital web printing presses, achieving the correct print result requires the actuation of the printing head and the conveyance of the print web through the printing area to be accurately coordinated with one another. In conventional digital web printing presses, this control is effected, for example, such that the printing head has an optical measuring apparatus arranged upstream of it that measures a current conveying speed of the print web. This conveying speed is taken as a basis for adapting the frequency at which the printing head outputs printing ink. Since the conveying speed is dependent on various factors and in particular can be variable over time, there is a resultant dynamic adaptation of the frequency. Errors in the capture of the conveying speed result directly in an erroneous printed image and/or a poor print quality. In order to achieve the desired print quality, the measurement and control system therefore needs to work very accurately, which is why thus requires a complex design.

SUMMARY OF THE INVENTION

In view the foregoing, it is an object of the present invention to provide an improved method for operating a digital web printing press.

This and other objects and advantages are achieved in accordance with the invention by a method for operating a digital web printing press that comprises, in a first step, selecting a frequency for actuating a digital printing head at the frequency to output printing ink onto a print web; in a second step, ascertaining a specified conveying speed for conveying the print web based on the selected frequency and printing data; in a third step, controller a motor driving a first roller and/or a motor driving a second roller is based on the specified conveying speed such that the print web between the first roller and the second roller, in particular directly below the digital printing head, is conveyed at the specified conveying speed and, in a fourth step, actuating the digital printing head at the selected frequency and on the basis of the printing data.

The method in accordance with the invention has the advantageously actuates the digital printing head of the web printing press at a selected, fixed frequency, which permits the elimination of a complex dynamic actuation of the digital printing head and an associated measurement and control system. A web printing press operated using the inventive method can therefore have a less complex design and, hence, is cheaper to produce. Controlling the conveying speed of the print web based on the frequency supervises the print result, in particular a printed image concordant with the printing data.

In the case of this method, a cause-and-effect chain is therefore contrary to the case of conventional methods. In the prior art, the print web is conveyed, the conveying speed is measured and the measured conveying speed is taken as a basis for varying the frequency of the printing head. This can lead to a cascade of errors, with measurement errors and control errors intensifying, so that the print result becomes unusable. This can be avoided with the method in accordance with the invention. Here, the frequency of the printing head is prescribed and the conveying speed of the print web is adapted accordingly. This is possible because a web conveying device for conveying the print web, in this case, for example, the first roller and the second roller with the associated control device, can convey the print web very constantly and precisely.

The digital printing head is in particular arranged above the print web between the first and second rollers. The specified conveying speed preferably relates to the position of the print web exactly below the printing head. As a result, the specified conveying speed for the print web is reached directly below the printing head, which means that the print result is concordant with the printing data.

The digital printing head (or printing head), comprises a plurality of printing nozzles, for example. The number determines in particular a maximum printing resolution of the printing head. Further, the maximum printing resolution is dependent on the size of a minimum quantity of printing ink that the printing head can deliver with a printing nozzle in one cycle. Here, cycle is understood to mean the length of one period at the selected frequency. The printing resolution is for example 9600 DPI, corresponding to a dot density of 9600 per inch (DPI=dots per inch). The frequency determines the regularity with which a respective printing nozzle can output printing ink. The quantity of printing ink to be output per cycle or per actuation can be adjustable for each nozzle of the printing head individually. Further, the quantity from cycle-to-cycle can be different and adjustable.

The printing ink is understood, in the present instance, to mean the consumable used to produce a print, for example, ink or toner. What material is used as printing ink is dependent on the printing technique used.

The printing data comprise the image to be printed, such as a machine-readable data record. The image to be printed is available as a digital image data record, for example, as a vector graphic or as a bitmap, also subsequently referred to as a template. This template is converted or translated into the printing data via a printer driver, for example, allowance being made for a maximum resolution of the printing head, in particular. The printing data comprise in particular a resolution at which the template needs to be reproduced. When the frequency is known and printing data are available, the specified conveying speed at which the print web needs to be conveyed below the printing head can be determined.

By way of example, the printing data comprise two lines set at a distance of 1 cm and need to be printed at right angles to the direction of conveyance of the print web. When the printing head resolution is known and the frequency of the printing head is prescribed, the specified conveying speed is obtained as the product of printing head resolution and frequency, for example. At a resolution of 10 000 dots per cm and a frequency of 10 kHz, a specified conveying speed of 1 cm/s or 0.6 m/min. is obtained, for example.

The specified conveying speed ascertained in this manner based on the selected frequency is set via appropriate control of the motors that drive the first roller and/or second roller conveying the print web. That is, the print web is conveyed at the specified conveying speed, so that correct printing in accordance with the printing template is ensured.

From a rotation frequency of the motor driving the respective roller, a gear ratio and the diameter of the respective roller, it is possible to infer a circumferential speed of the respective roller. If a printing material is thin, such as up to 0.5 mm, and if no slippage occurs between the print web and a respective roller, then the circumferential speed of the respective roller corresponds to the conveying speed of the print web at the roller. The print web is conveyed with a specific tensile stress, for example. This can lead to stretching of the print web, which is why a conveying speed at the first roller and at the second roller can be different and can also assume different values between the rollers, which needs to be taken into consideration for the control.

If the print web is conveyed at the specified conveying speed and the printing head is actuated in accordance with the printing data and at the frequency, then the print result attained, the print, will correspond to the template. In particular, the dimensions of the print and a color intensity will correspond to those of the template.

In accordance with one embodiment of the method, a conveying parameter of the first roller and/or of the second roller is captured and a conveying speed of the print web is ascertained based on the captured conveying parameter. The ascertained conveying speed is taken as a basis for controlling the first motor and/or the second motor, so that the conveying speed corresponds to the specified conveying speed. This presently contemplated embodiment has the advantage that an actual conveying speed is ascertained and is used to control the motors to convey the print web at the specified conveying speed.

A conveying parameter comprises, for example, a rotation frequency, a torque, a diameter, a wrap of the respective roller with the print web and/or a coefficient of friction between the respective roller and the print web. The wrap indicates, for example, what proportion of the respective roller is wrapped by the print web. The wrap can be indicated as an angle, for example. The coefficient of friction relates in particular to a respective combination of a roller with a specific material.

These parameters can influence a conveying characteristic, in particular the conveying speed. From the speed or torque of the respective motor, it is possible to infer the speed or torque of the respective roller. To this end, a transfer function is preferably known that makes allowance for a gear ratio and/or a loss value, for example.

The ascertained conveying speed can comprise a first conveying speed of the print web at the first roller, a second conveying speed of the print web at the second roller and/or a conveying speed at one or more points between the two rollers.

In accordance with a further embodiment of the method, a print web parameter of the print web is captured and the first motor and/or the second motor is controlled on the basis of the captured print web parameter. The presently contemplated embodiment has the advantage that allowance is made for parameters of the print web that can influence a conveying characteristic, in particular a conveying speed.

Print web parameters comprise in particular material parameters, such as a modulus of elasticity and/or a behavior of the printing material when printed. Furthermore, allowance can be made for geometric parameters, such as a thickness of the printing material and/or a width of the print web.

By way of example, a thickness of the printing material can be variable, which can directly influence the conveying speed. In this embodiment, for example, the material thickness is captured and the conveying speed is controlled accordingly based on the captured thickness.

In accordance with another embodiment of the method, a register mark is periodically printed onto the print web by the digital printing head. Subsequently, a distance between two successively printed register marks on the print web is captured and the first motor and/or the second motor is controlled based on the captured distance. The presently contemplated embodiment has the advantage that the print result achieved is directly checkable via the register marks, and control of the roller drive, i.e., the first motor and/or of the second motor, can be adapted accordingly.

Periodic printing of register marks is preferably understood to mean that there is a fixed time interval between two register marks printed at successive times, such as one second. From the captured distance between two successively printed register marks, the actual conveying speed is obtained, for example, as the quotient of the distance divided by the time interval. By way of example, a specific register mark sensor can be arranged downstream of the printing head in the direction of conveyance.

Apart from the distance, it is also possible for a color saturation or color intensity of the register marks to be captured, for example. If the saturation is too low, the quantity of printing ink output by a printing nozzle per cycle can be adapted, for example.

In accordance with a further embodiment of the method, image data are generated based on a printed design printed onto the print web by the digital printing head. The image data are compared with the printing data. The first motor and/or the second motor are controlled based on a result of the comparison.

The presently contemplated embodiment is advantageous because at least some, advantageously also the entirety, of the print result is captured and checked via the comparison. By way of example, a digital image sensor, such as a charge-coupled device (CCD) camera, is arranged downstream of the printing head in the direction of conveyance and captures the image data. Comparison is understood to mean in particular that, for example, a dimension of a printed graphic is compared with the dimension of the graphic in the printing data. By way of example, a difference is formed between the captured value and the theoretical value. If the result of the difference is positive, then the printed graphic is larger than the template (conveying speed too high), and if the difference is negative, then the printed graphic is smaller than the template (conveying speed too low). An erroneous conveying speed therefore leads to expansion or compression of a graphic in comparison with the template, which can be corrected in accordance with the present embodiment by adapting the conveying speed.

Moreover, in the presently contemplated embodiment, it is also possible to compare a color saturation or color intensity of the printed graphic with the template, and the output quantity of printing ink from a printing nozzle per cycle can be adapted accordingly.

In accordance with a further embodiment of the method, an output quantity of the printing ink for a printing nozzle of the digital printing head in one period of the selected frequency is set based on the printing data and the set conveying speed. This embodiment is advantageous because it allows a maximum color intensity or printing density to be adapted. Further, shadings or color gradations can also be produced at different conveying speeds in the same way.

It is also an object of the invention to provide a control apparatus for operating a digital web printing press. The control apparatus comprises an adjusting unit for setting a selected frequency, an ascertaining unit for ascertaining a specified conveying speed of a print web based on a frequency and printing data, a controller for controlling a first motor driving a first roller and/or a second motor driving a second roller to set the conveying speed of the print web running between the first roller and the second roller based on the ascertained specified conveying speed, and an actuating unit for actuating a digital printing head to output printing ink at the frequency and based printing data.

The disclosed control apparatus is advantageously configured to operate a digital web printing machine in accordance with the disclosed embodiments of the method in accordance with the invention, which results in the aforementioned advantages. The embodiments and features explained in regard to the method apply to the control apparatus, accordingly.

At least some of the control apparatus is implemented in hardware, but at least some of the control apparatus can also be implemented in software. The control apparatus can be formed as a computer or as a microprocessor, for example. Parts that are implemented in software take the form of a computer program product, in the form of a function, in the form of a routine, in the form of part of a program code or in the form of an executable object, for example.

The adjusting unit preferably comprises a clock generator configured to output the selected frequency.

In accordance with one embodiment, the control apparatus comprises a first capture unit for capturing a conveying parameter of the first roller and/or the second roller, where the ascertaining unit is configured to ascertain the conveying speed based on the captured operating parameter. The control unit is configured to control the first motor and/or the second motor based on the ascertained conveying speed. Advantageously, the conveying speed is therefore controlled based on the conveying speed derived from the conveying parameters.

A conveying parameter comprises for example a rotation frequency, a torque, a diameter, a wrap of the respective roller with the print web and/or a coefficient of friction between the respective roller and the print web. The wrap indicates, for example, what proportion of the respective roller is wrapped by the print web. The wrap can be indicated as an angle, for example. The coefficient of friction relates in particular to a respective combination of a roller with a specific material.

These parameters can influence a conveying characteristic, i.e., the conveying speed. From the speed or torque of the respective motor, it is possible to infer the speed or torque of the respective roller. To this end, a transfer function is preferably known that makes allowance for a gear ratio and/or a loss value, for example.

The ascertained conveying speed can comprise a first conveying speed of the print web at the first roller, a second conveying speed of the print web at the second roller and/or a conveying speed at one or more points between the first and second rollers.

In accordance with a further embodiment, the control apparatus comprises a second capture unit for capturing a print web parameter of the print web. The ascertaining unit is configured to ascertain the conveying speed based on the captured print web parameter. The controller is configured to control the first motor and/or the second motor based on the ascertained conveying speed. Advantageously, the conveying speed is therefore controlled based on the conveying speed derived from the print web parameters.

Print web parameters comprise in particular material parameters such as a modulus of elasticity and/or a behavior of the printing material when printed. Furthermore, allowance can be made for geometric parameters such as a thickness of the printing material and/or a width of the print web.

By way of example, a thickness of the printing material can be variable, which directly influences the conveying speed. In the presently contemplated embodiment, for example, the material thickness is captured and the conveying speed is controlled in accordance with the captured thickness.

In accordance with yet a further embodiment, the control apparatus comprises a third capture unit for capturing sensor data from the printed print web and a correction unit for ascertaining a correction value on the basis of the printing data and the captured sensor data. The ascertaining unit is configured to ascertain a corrected conveying speed based on the correction value, and the controller is configured to control the first motor driving the first roller and/or the second motor driving the second roller to set the corrected conveying speed. This embodiment is advantageous because it allows errors in a printed image that can arise, for example, based erroneous assumptions and/or inaccuracies in a physical model of the operated web printing press upon which the ascertainment of the conveying speed is based, to be directly corrected based on an actually attained print result.

The third capture unit comprises for example an optical sensor, such an image sensor, which captures the printed design that has been printed and converted into image data. The correction unit compares the captured image data with the printing data. The correction unit is part of the ascertaining unit, for example. In particular, the correction unit ascertains whether the image data are concordant with the printing data with respect to the dimensions of graphics and the color intensities or whether there are discrepancies. Moreover, the type of discrepancy is ascertained, for example, whether there is compression or expansion. An appropriate correction value is ascertained and output. The correction value is used to ascertain a corrected conveying speed, such as via addition or multiplication.

It is also an object of the invention to provide a web printing press having a print web running between a driven first roller and a driven second roller. A digital printing head for outputting printing ink onto the print web is arranged between the first roller and the second roller above the print web. The web printing press additionally comprises a control apparatus which is configured to operate the web printing press.

The web printing press in accordance with the invention can advantageously be operated in accordance with the disclosed embodiments of the method in accordance with the invention via the control apparatus, which results in the aforementioned advantages. The embodiments and features explained in with respect to the disclosed embodiments of the method apply to the web printing press, accordingly.

In accordance with an embodiment, the web printing press comprises a device for capturing a conveying parameter of the first roller and/or of the second roller. The control apparatus is configured to operate the printing press based on the basis of the captured conveying parameter.

The device comprises a sensor that captures, for example, a circumferential speed of the respective roller and/or a torque at the roller surface of the respective roller as the conveying parameter. The control apparatus takes into consideration the conveying parameter in particular to control the motors that drive the respective roller. The conveying parameter can also be a derived value, for example it is possible for the circumferential speed or the torque at the roller surface to be inferred from a speed or torque of a motor when the gear ratio and the roller diameter are known.

In accordance with a further embodiment, the web printing press comprises a device for capturing a print web parameter of the print web, where the control apparatus is configured to operate the printing press based on the captured material parameter.

The device comprises in particular a sensor that captures, for example, a conveying speed and/or a tensile stress of the print web in the region of the first roller, in the region of the second roller and/or between the rollers as the print web parameter. Preferably, the sensor operates contactlessly, such as for example an optical sensor, so that the sensor does not influence the conveying characteristic. It should be pointed out that the print web parameter is used not to adapt an actuation frequency of the printing head but rather to control the conveying speed of the print web. Further print web parameters are, for example, material parameters of the printing material used, such as a modulus of elasticity.

In accordance with a still further embodiment, the web printing press, comprises a sensor, arranged downstream of the digital printing head in the direction of conveyance of the print web, for capturing sensor data from the printed print web. The control apparatus is configured to ascertain a correction value based on the captured sensor data and the printing data and to operate the web printing press based on the correction value. The presently contemplated embodiment is advantageous because it allows errors in a printed image that can arise, for example, based on erroneous assumptions and/or inaccuracies in a physical model of the operated web printing press upon which the ascertainment of the conveying speed is based, to be directly corrected based on an actually attained print result.

The sensor is preferably an optical sensor and configured to capture register marks and/or the printed design that has been printed. Register marks are in particular markings periodically printed onto the print web by the digital printing head. The register marks are therefore part of the printing data. A distance between two successively printed register marks is dependent on the conveying speed. It is thus possible to infer the conveying speed from the distance, and the conveying speed can therefore be controlled accordingly. If the printed design that has been printed is captured, it is possible for a concordance between the printed design that has been printed and the printing data to be ascertained. Based on whether the printed design that has been printed is concordant with the printing data or how it differs therefrom, it is possible to ascertain a correction value, in particular for the conveying speed that is to be set, in order to achieve concordance.

It is also an object of the invention to provide a computer program product that prompts the performance of the method as explained above on a program-controlled device.

A computer program product, such as a computer program means can, for example, be provided or supplied as a storage medium, such as a memory card, USB stick, CD-ROM, DVD, or as a downloadable file from a server in a network. This can be effected in a wireless communication network, for example, via transmission of an appropriate file with the computer program product or the computer program means.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is explained in more detail below on the basis of preferred embodiments with reference to the accompanying figures, in which.

DETAILED DESCRIPTION OF THE EXEMPLARY EMBODIMENTS

In the figures, elements that are the same or have the same function have been provided with the same reference signs, unless indicated otherwise.

Figure 1:
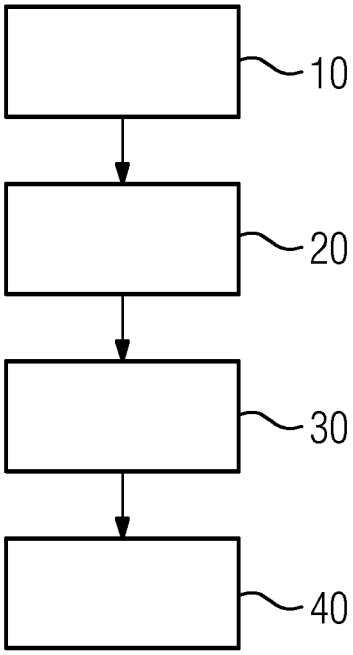
FIG. 1 is an illustration of a schematic block diagram of an exemplary embodiment of a method for operating a digital web printing press.
Figure 3:
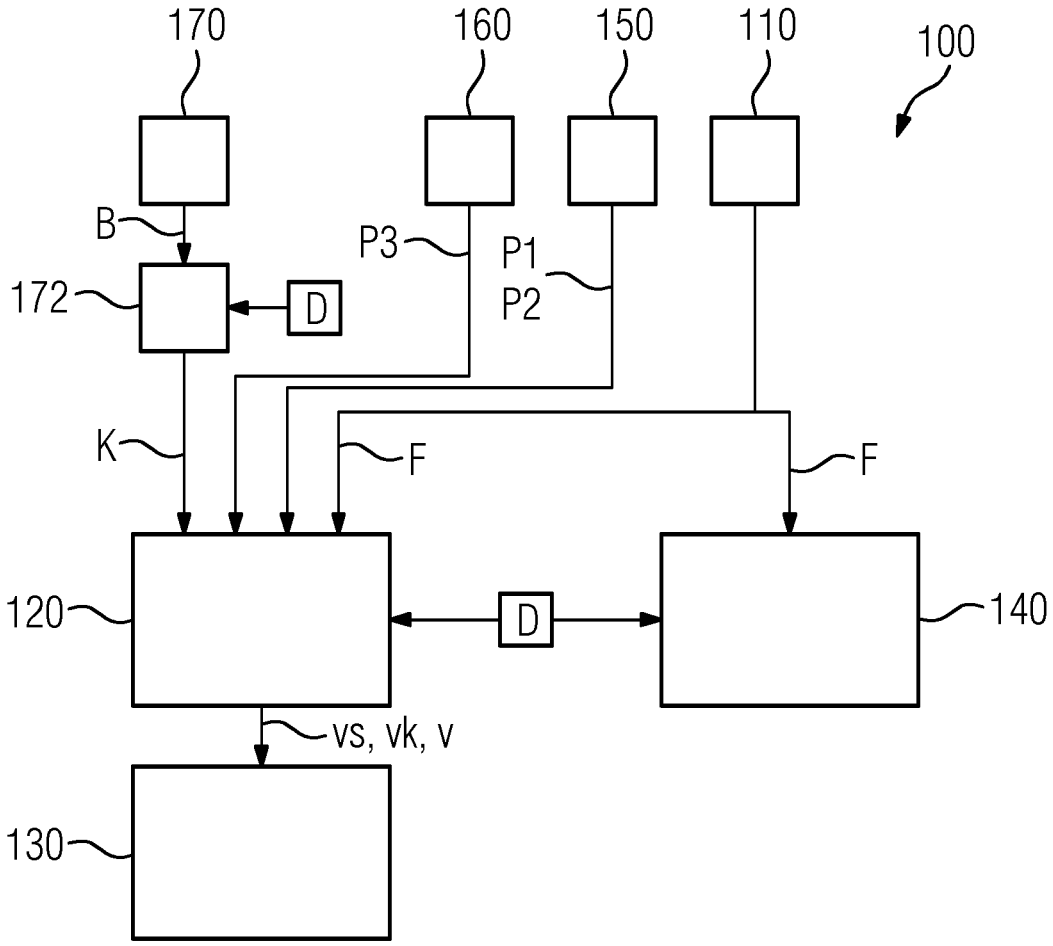
FIG. 3 is an illustration of a schematic block diagram of a second exemplary embodiment of a control apparatus in accordance with the invention.
Figure 4:
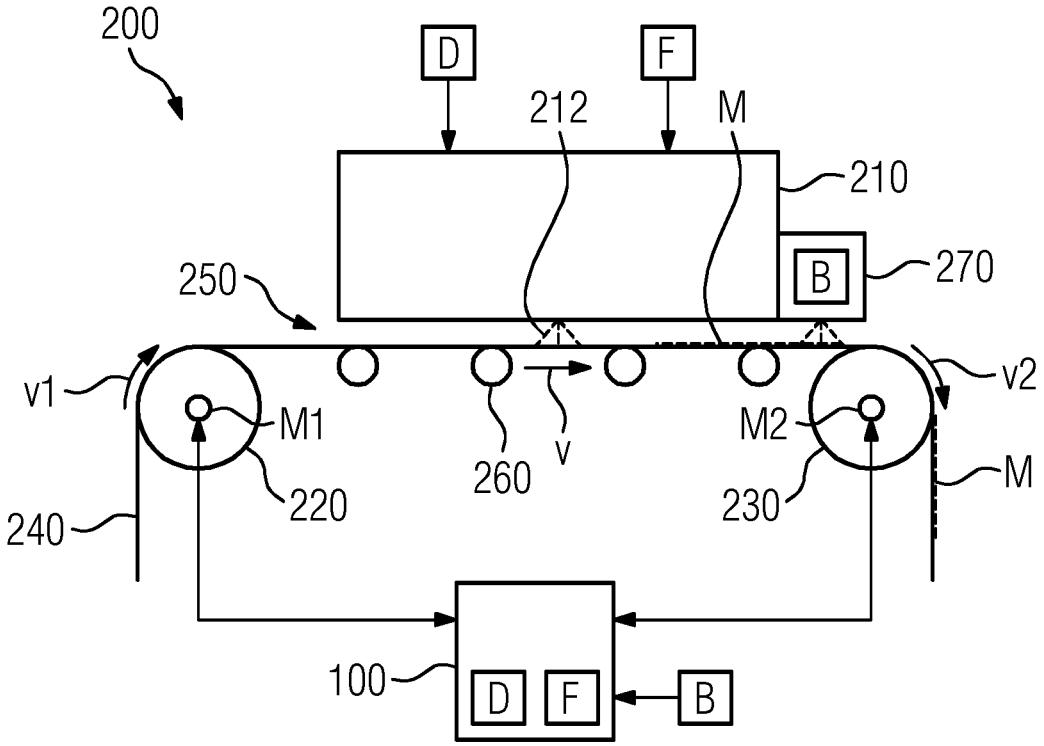
FIG. 4 is a schematic illustration of an exemplary embodiment of a web printing press in accordance with the invention.

FIG. 1 shows a schematic block diagram of an exemplary embodiment of a method for operating a digital web printing press 200 (see FIG. 4). In a first step 10, a frequency F (see FIGS. 2 to 4) at which the digital printing head 210 (see FIG. 4) is actuated to output printing ink 212 (see FIG. 4) is selected. Here, selecting is understood to mean, for example, that an operator of the web printing press 200 inputs the frequency F using a suitable input means. Alternatively, the frequency F can be derived from specific constraints. Furthermore, there can be provision for the frequency F to be firmly prescribed by the printing head 210, for example, because the printing head can only be operated at a specific frequency F.

In a second step 20, the selected frequency F is taken as a basis for ascertaining a specified conveying speed vs (see FIGS. 2 and 3) for the conveying speed v (see FIG. 4). The specified conveying speed vs can be ascertained, in particular calculated, from an association between the frequency F and a desired printing resolution, for example. The printing resolution is obtained from printing data D (see FIGS. 2 to 4).

In a third step 30, the rollers 220, 230 (see FIG. 4) that convey a print web 240 (see FIG. 4) through a printing region 250 (see FIG. 4) are controlled such that the conveying speed v of the print web 240 corresponds to the specified conveying speed vs. This is accomplished in particular by virtue of a first motor M1 (see FIG. 4) that drives the first roller 220, and/or a second motor M2 that drives the second roller 220, being controlled accordingly.

In a fourth step 40, the digital printing head 210 is actuated at the selected frequency F and with the printing data D.

The inventive method can be employed in particular to operate a web printing press 200 whose printing head 210 is not actuated based on a captured conveying speed of the print web 240 at a variable frequency.

Figure 2:
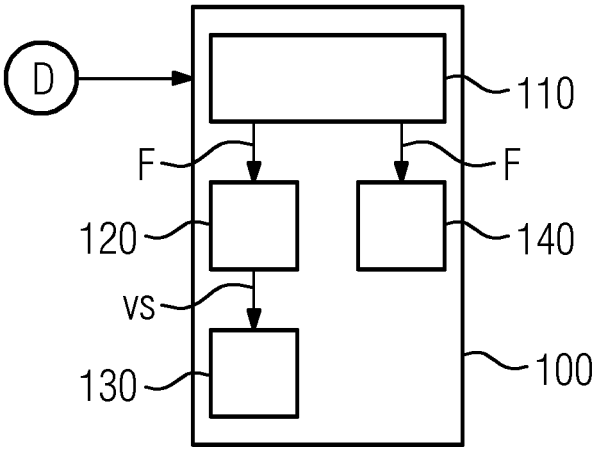
FIG. 2 is an illustration of a schematic block diagram of a first exemplary embodiment of a control apparatus in accordance with the invention.

FIG. 2 shows a schematic block diagram of a first exemplary embodiment of a control apparatus 100 that can operate a web printing press 200 via the above-described method. The control apparatus 100 comprises an adjusting unit 110 configured to set a selected frequency F. The adjusting unit 110 comprises in particular a clock generator. Furthermore, the adjusting unit 110 can have an input means or a receiving means for selecting the frequency F.

The adjusting unit 110 outputs the selected and set frequency F to an ascertaining unit 120 and an actuating unit 140. The ascertaining unit 120 is configured to ascertain a specified conveying speed vs based on the frequency F and printing data D. The printing data D are in particular prescribed or input externally and comprise for example a printed design M to be printed (see FIG. 4) as machine-readable data. The actuating unit 140 is configured to read the printing data D and to actuate a digital printing head 210 (see FIG. 4) accordingly. Here, printing nozzles (not shown) of the digital printing head 210 are actuated to output printing ink 212 (see FIG. 4) at the frequency F. That is, in each period of the frequency F, a printing nozzle outputs a specific quantity or a specific volume of the printing ink 212. The printing ink 212 output in one period produces a picture element on the print web 240.

The ascertaining unit 120 outputs the ascertained specified conveying speed vs to a controller 130. The controller 130 takes the specified conveying speed vs as a basis for controlling a first motor M1 (see FIG. 4) that drives the first roller 220 (see FIG. 4), and/or a second motor M2 (see FIG. 4) that drives a second roller 230 (see FIG. 4). This control sets the conveying speed v (see FIG. 4) of the print web 240 to the specified conveying speed vs. This ensures that the printed design M that has been printed is concordant with the printing data D.

FIG. 3 shows a schematic block diagram of a second exemplary embodiment of a control apparatus 100 that can operate a web printing press 200 via the above-described method. This second exemplary embodiment has all the features of the first exemplary embodiment of FIG. 2. Furthermore, the control apparatus 100 in this case comprises three capture units 150, 160, 170 and a correction unit 172.

The first capture unit 150 is configured to capture a conveying parameter P1, P2 of the first roller 200 (see FIG. 4) and/or of the second roller 230 (see FIG. 4). The first conveying parameter P1 comprises, for example, a conveying speed v1 (see FIG. 4) of the first roller 220 and the second conveying parameter P2 comprises, for example, a circumferential speed v2 (see FIG. 4) of the second roller 230. The ascertaining unit 120 is configured to ascertain the conveying speed v of the print web 240 based on the parameters P1, P2. The controller 130 is configured to control the conveying speed v based on the ascertained conveying speed v.

The second capture unit 160 is configured to capture a print web parameter P3 that is, for example, a thickness of the print web 240. The ascertaining unit 120 is configured to ascertain the conveying speed v of the print web 240 based on the parameter P3. The controller 130 is configured to control the conveying speed v based on the ascertaining conveying speed v.

The third capture unit 170 is configured to capture image data B of a printed design M (see FIG. 4) printed by the digital printing head 210 (see FIG. 4). The correction unit 172 takes the captured image data B and the printing data D as a basis for ascertaining a correction value K. The correction value K is used by the ascertaining unit 120 to ascertain a corrected conveying speed vk. By way of example, the corrected conveying speed vk is a sum of the specified conveying speed vs and the correction value K. The ascertaining unit 120 outputs the specified conveying speed vs or the corrected conveying speed vk to the controller 130, where the controller 130 then controls the conveying speed v of the print web 240 accordingly.

FIG. 4 schematically shows an exemplary embodiment of a web printing press 200. The web printing press 200 comprises in particular a control apparatus 100 that is configured to operate the web printing press 200. The control apparatus 100 can correspond to one of the exemplary embodiments shown in FIG. 2 or FIG. 3, for example. The control apparatus 100 is configured to perform the method described on the basis of FIG. 1.

The web printing press 200 comprises a digital printing head 210 that is arranged above a print web 240. The digital printing head 210 is configured to output printing ink 212 onto the print web 240 by means of printing nozzles (not shown). The region in which the printing head 210 can output printing ink 212 onto the print web 240 is referred to as the printing region 250.

The printing region 250 is situated between a first roller 220 and a second roller 230 that convey the print web 240. The first roller 220 can also be referred to as the feed roller, and the second roller 230 can also be referred to as the discharge roller. Arranged between the rollers 220, 230 are four guide rollers 260, which serve to support and guide the print web 240 in the printing region 250. For reasons of clarity, only one guide roller 260 is denoted by a reference sign. The guide rollers 260 are not driven and are preferably mounted so as to be very smoothly rotatable, so that they rotate with the print web 240 without affecting it.

The first roller 220 is driven by a first motor M1, and the second roller 230 is driven by a second motor M2. The motors M1, M2 are in particular electric motors and drive the rollers 220, 230 directly, i.e., there is no gearbox between the motor M1, M2 and the respective roller 220, 230. This allows particularly exact control of the conveying speed v of the print web 240 to be produced.

The control apparatus 100 operates the web printing press 200. This is effected in accordance with the method described on the basis of FIG. 1. The control apparatus 100 operates the web printing press 200 based on printing data D and a selected frequency F. The frequency F determines the time intervals in which a printing nozzle of the printing head 210 can output printing ink 212. The control apparatus 100 takes the frequency F and the printing data D as a basis for ascertaining the specified conveying speed vs at which the print web 240 needs to be conveyed through the printing region 250, so that the printed design M that has been printed is concordant with the printing data D. For this purpose, the control apparatus 100 comprises in particular an ascertaining unit 120 (see FIG. 2 or 3). The control apparatus 100 additionally comprises a controller 130 (see FIG. 2 or 3) that controls the motors M1, M2 such that the print web 240 is conveyed at the specified conveying speed vs.

In this exemplary embodiment, the printing press 200 furthermore comprises an optional sensor 270 which, in this instance, is formed as a charge-coupled device (CCD) camera. The CCD camera 270 is arranged downstream of the printing head 210 in the direction of conveyance. The CCD camera 270 captures the printed designs M printed by the printing head 210 and converts them into image data B. The image data B are output to the control apparatus 100, which monitors whether the image data B are concordant with the printing data D, i.e., whether the attained print result corresponds to the printing data D. If there is a discrepancy between the image data B and the printing data D, then a correction unit 172 (see FIG. 3) ascertains a correction value K, which the control apparatus 100 takes into consideration for operating the web printing press 200. In particular, the conveying speed v of the print web 240 is set to a corrected conveying speed vk. Moreover, an output quantity of printing ink 212 through a printing nozzle per actuation period can also be adapted, for example, if a color intensity of the printed design M that has been printed differs from the printing data D. In the case of multicolored prints, it is also possible for a color mix to be adapted.

Although the present invention has been described on the basis of exemplary embodiments, it is modifiable in a wide variety of ways.

Thus, while there have been shown, described and pointed out fundamental novel features of the invention as applied to a preferred embodiment thereof, it will be understood that various omissions and substitutions and changes in the form and details of the methods described and the devices illustrated, and in their operation, may be made by those skilled in the art without departing from the spirit of the invention. For example, it is expressly intended that all combinations of those method steps which perform substantially the same function in substantially the same way to achieve the same results are within the scope of the invention. Moreover, it should be recognized that method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for operating a digital web printing press comprising an adjusting unit and an ascertaining unit, the method comprising:

selecting, by the adjusting unit, a frequency for actuating a digital printing head at the frequency to output printing ink onto a print web;

ascertaining, by the ascertaining unit, a specified conveying speed for conveying the print web based on the selected frequency and printing data;

controlling a motor driving at least one of (i) a first roller and (ii) a motor driving a second roller based on the specified conveying speed such that the print web is conveyed at the specified conveying speed; and actuating the digital printing head at the selected frequency and based on the printing data.

2. The method as claimed in claim 1, further comprising:

capturing a conveying parameter of at least one of (i) the first roller and (ii) the second roller;

ascertaining a conveying speed of the print web based on the captured conveying parameter; and controlling at least one of (i) the first motor and (ii) the second motor based on the ascertained conveying speed to ensure the conveying speed corresponds to the specified conveying speed.

3. The method as claimed in claim 1, further comprising:

capturing a print web parameter of the print web; and controlling at least one of (i) the first motor and (ii) the second motor based the captured print web parameter.

4. The method as claimed in claim 2, further comprising:

capturing a print web parameter of the print web; and controlling at least one of (i) the first motor and (ii) the second motor based the captured print web parameter.

5. The method as claimed in claim 1, further comprising:

periodically printing a register mark onto the print web via the digital printing head;

capturing a distance between two successively printed register marks on the print web; and controlling at least one of (i) the first motor and (ii) the second motor based on the captured distance.

6. The method as claimed in one of claim 1, further comprising:

generating image data based on a printed design printed onto the print web by the digital printing head;

comparing the generated image data with the printing data; and controlling at least one of (i) the first motor and (ii) the second motor based on a result of the comparison.

7. The method as claimed in claim 1, further comprising:

setting an output quantity of the printing ink for a printing nozzle of the digital printing head in one period of the selected frequency based on the printing data and the specified conveying speed.

8. The method as claimed in claim 1, wherein the print web between the first roller and the second roller is directly below the digital printing head.

9. A control apparatus for operating a digital web printing press, comprising:

an adjusting unit for setting a selected frequency;

an ascertaining unit for ascertaining a specified conveying speed of a print web based on the frequency and printing data;

a controller for controlling at least one of (i) a first motor driving a first roller and (ii) a second motor driving a second roller to set a conveying speed (v) of the print web running between the first roller and the second roller based on the specified conveying speed; and an actuating unit for actuating a digital printing head to output printing ink at the frequency and based on the printing data.

10. The control apparatus as claimed in claim 9, further comprising:

a first capture unit for capturing a conveying parameter of at least one of (i) the first roller and (ii) the second roller;

wherein the ascertaining unit is configured to ascertain the conveying speed (v) based on the captured operating parameter and the controller is configured to control at least one of (i) the first motor and (ii) the second motor based on the ascertained conveying speed.

11. The control apparatus as claimed in claim 9, further comprising:

a second capture unit for capturing a print web parameter of the print web;

wherein the ascertaining unit is configured to ascertain the conveying speed based on the captured print web parameter and the controller is configured to control at least one of (i) the first motor and (ii) the second motor based on the ascertained conveying speed.

12. The control apparatus as claimed in claim 10, further comprising:

a second capture unit for capturing a print web parameter of the print web;

wherein the ascertaining unit is configured to ascertain the conveying speed based on the captured print web parameter and the controller is configured to control at least one of (i) the first motor and (ii) the second motor based on the ascertained conveying speed.

13. The control apparatus as claimed in claim 9, further comprising:

a third capture unit for capturing sensor data from the printed print web; and a correction unit for ascertaining a correction value based on the printing data and the sensor data;

wherein the ascertaining unit is configured to ascertain a corrected conveying speed based on the correction value and the controller is configured to control at least one of (i) the first motor driving the first roller and (ii) the second motor driving the second roller to set the corrected conveying speed.

14. The control apparatus as claimed in claim 10, further comprising:

a third capture unit for capturing sensor data from the printed print web; and a correction unit for ascertaining a correction value based on the printing data and the sensor data;

wherein the ascertaining unit is configured to ascertain a corrected conveying speed based on the correction value and the controller is configured to control at least one of (i) the first motor driving the first roller and (ii) the second motor driving the second roller to set the corrected conveying speed.

15. The control apparatus as claimed in claim 11, further comprising:

a third capture unit for capturing sensor data from the printed print web; and a correction unit for ascertaining a correction value based on the printing data and the sensor data;

wherein the ascertaining unit is configured to ascertain a corrected conveying speed based on the correction value and the controller is configured to control at least one of (i) the first motor driving the first roller and (ii) the second motor driving the second roller to set the corrected conveying speed.

16. A web printing press having a print web running between a driven first roller and a driven second roller, comprising:

a digital printing head, arranged between the first roller and the second roller above the print web, for outputting printing ink onto the print web; and a control apparatus as operating the web printing press comprising:

an adjusting unit for setting a selected frequency;

an ascertaining unit for ascertaining a specified conveying speed of the print web based on the frequency and printing data;

a controller for controlling at least one of (i) a first motor driving the first roller and (ii) a second motor driving the second roller to set a conveying speed of the print web running between the first roller and the second roller based on the specified conveying speed; and an actuating unit for actuating the digital printing head to output printing ink at the frequency and based on the printing data.

17. The web printing press as claimed in claim 16, further comprising:

a device for capturing a conveying parameter of at least one of (i) the first roller and (ii) the second roller;

wherein the control apparatus is configured to operate the printing press based on the captured conveying parameter.

18. The web printing press as claimed in claim 16, further comprising:

a device for capturing a print web parameter of the print web;

wherein the control apparatus is configured to operate the printing press based on the captured print web parameter.

19. The web printing press as claimed in claim 17, further comprising:

a second device for capturing a print web parameter of the print web;

wherein the control apparatus is configured to operate the printing press based on the captured print web parameter.

20. The web printing press as claimed in claim 16, further comprising:

a sensor, arranged downstream of the digital printing head in the direction of conveyance of the print web, for capturing sensor data from the printed print web;

wherein the control apparatus is configured to ascertain a correction value based on the captured sensor data and the printing data and is further configured to operate the web printing press based on the correction value.

21. The web printing press as claimed in claim 17, further comprising:

a sensor, arranged downstream of the digital printing head in the direction of conveyance of the print web, for capturing sensor data from the printed print web;

wherein the control apparatus is configured to ascertain a correction value based on the captured sensor data and the printing data and is further configured to operate the web printing press based on the correction value.

22. The web printing press as claimed in claim 18, further comprising:

a sensor, arranged downstream of the digital printing head in the direction of conveyance of the print web, for capturing sensor data from the printed print web;

wherein the control apparatus is configured to ascertain a correction value based on the captured sensor data and the printing data and is further configured to operate the web printing press based on the correction value.

* * * * *